United States Patent [19]

Flory

[11] Patent Number: 4,459,930

[45] Date of Patent: Jul. 17, 1984

[54] RISER AND DETACHABLY COUPLED YOKE MOORING SYSTEM

[75] Inventor: John F. Flory, Morris Township, Morris County, N.J.

[73] Assignee: Exxon Research and Engineering Co., Florham Park, N.J.

[21] Appl. No.: 393,105

[22] Filed: Jun. 28, 1982

[51] Int. Cl.[3] ..... B63B 21/00

[52] U.S. Cl. ..... 114/230; 141/387; 441/5

[58] Field of Search ..... 114/230, 248–250; 441/3–5; 141/387, 388; 280/512; 403/127

[56] References Cited

U.S. PATENT DOCUMENTS

| | | | |
|---|---|---|---|
| 1,983,655 | 12/1934 | Bowman et al. | 403/127 |
| 3,175,845 | 3/1965 | McClive | 403/127 X |
| 3,407,768 | 10/1968 | Graham | 441/5 X |
| 3,572,408 | 3/1971 | Hnot | 141/387 |
| 3,809,002 | 5/1974 | Nagy et al. | 114/249 |
| 3,964,423 | 6/1976 | Gassett et al. | 441/3 |
| 4,088,089 | 5/1978 | Flory | 114/230 |
| 4,114,556 | 9/1978 | Orndorff, Jr. et al. | 114/230 |

FOREIGN PATENT DOCUMENTS

| | | | |
|---|---|---|---|
| 54-100086 | 8/1979 | Japan | 114/250 |

*Primary Examiner*—Sherman D. Basinger
*Attorney, Agent, or Firm*—Donald F. Wohlers

[57] ABSTRACT

A yoke mooring system pivoted on the forecastle of a vessel, such as a shuttle tanker, is detachably coupled to a riser which is attached to a base located on the ocean floor. The yoke mooring system includes clamping arms which engage a ball with an axial passage at the upper end of the riser. Hydraulic cylinders raise and lower the yoke, and a hydraulic cylinder shifts mechanical linkages to open and close clamping arms mounted on the yoke. A socket is formed in the clamping arms to receive the ball. Cargo piping on the vessel is joined to the ball through hoses and a fluid swivel. Fluid cargo can pass upwardly through the riser, through the ball, through the fluid swivel and hoses, and then through cargo piping to storage tanks on the vessel. Bearings situated between the riser and the ball allow the ball to rotate such that, when the clamping arms are coupled to the ball, the vessel can rotate about the riser without disrupting fluid flow or damaging the riser. In a preferred embodiment, the riser houses a normally closed valve, which is opened to allow fluid flow when the yoke exerts an upward force on the ball. Other embodiments suggest diverse configurations and locations for the bearings, alternative valves for regulating fluid flow, modifications to the ball, etc.

31 Claims, 9 Drawing Figures

RISER AND DETACHABLY COUPLED YOKE MOORING SYSTEM

BACKGROUND OF THE INVENTION

U.S. Pat. No. 4,088,089, granted May 9, 1978 to the instant applicant and assigned to the corporate assignee of this invention, discloses a unique riser and yoke mooring system that is well suited for the permanent mooring of storage vessels and floating production systems which receive and store or process crude oil from an offshore oil field. The mooring system disclosed in said patent includes a riser, a yoke pivoted on the vessel, and counterweights, winches, or the like operably associated with the yoke to exert a tension force upon the riser. The top of the mooring leg is connected to the end of the yoke through a mooring swivel and a gimbaled mooring table or a universal joint. A fluid swivel may be located above the mooring table, or about a load-carrying shaft connected to the mooring leg.

While the mooring swivel, the gimbaled mooring table, or the universal joint and related components, all are satisfactory to permanently join the riser and yoke together so that fluid cargo can pass up the riser and into storage facilities on the vessel, with the riser and yoke thus joined together, the mooring connection cannot readily be separated and then re-established. Thus, the existing riser and yoke mooring system is well-suited for use in those instances where permanent, long term mooring for vessels are necessary, but is not suited for temporary mooring of vessels which must frequently depart the mooring to shuttle cargo to shore facilities or to avoid severe weather and sea conditions.

SUMMARY OF THE INVENTION

The present invention relates generally to vessel moorings and more particularly to diverse, simple, readily connected and disconnected yoke mooring systems for temporarily or intermittently mooring a floating vessel to a riser attached to the sea floor. The vessel may be a shuttle tanker which transports crude oil from a production field to a refinery or a shore-based storage depot. The vessel may be a work barge, a research vessel, a liquid gas carrier, or the like. Fluid cargo, communication signals, electricity, or hydraulic power can be conducted between the sea floor and the vessel through the riser.

The present invention contemplates a riser with a ball secured to its upper end which mates with clamps mounted on a yoke mooring system to comprise a detachable coupling that can be safely established, dropped and reestablished. The present invention further contemplates the use of bearings between the ball and the riser to allow the vessel to rotate about the riser while maintaining the integrity of the coupling and swivels between the top of the riser and cargo hoses on the yoke mooring system to allow cargo loading to continue while the vessel rotates.

The present invention further contemplates the use of a valve situated adjacent to the top of the riser and linked to the ball such that it is normally closed to prevent fluid flow through the riser but that it is opened when the coupling is established and the yoke is raised to exert an upward force on the ball, thus permitting cargo flow through the riser. When the upward force is released, the valve in the riser then automatically closes to terminate the cargo flow under the influence of a biasing spring.

Several alternative embodiments of the yoke mooring system with various bearing and valving arrangements are contemplated. In one alternative embodiment, flow through the riser is controlled by a seal cone moving axially relative to a seal face, and bearings permitting rotation of the vessel are positioned within the riser. In another embodiment, roller segments in the clamping arms bear on a conical collar which rotates on the riser. In another embodiment the rollers engage a conical ring which is connected by a gimbal to the riser. Lastly, a simpler embodiment employs a ball on a hook at the top of the riser that fits into a spherical socket on the yoke to establish a detachable coupling.

The riser pipe is held substantially upright by a large buoyant float to assist in establishing the detachable mooring. The detachable couplings are located above the waterline so that the components are not subjected to continuous wetting by corrosive salt water.

Other advantages and attributes of the several embodiments of the detachable coupling will become readily apparent to the skilled artisan when the appended drawings are construed along with the accompanying specification.

DESCRIPTION OF THE PREFERRED EMBODIMENT

Figure 1:
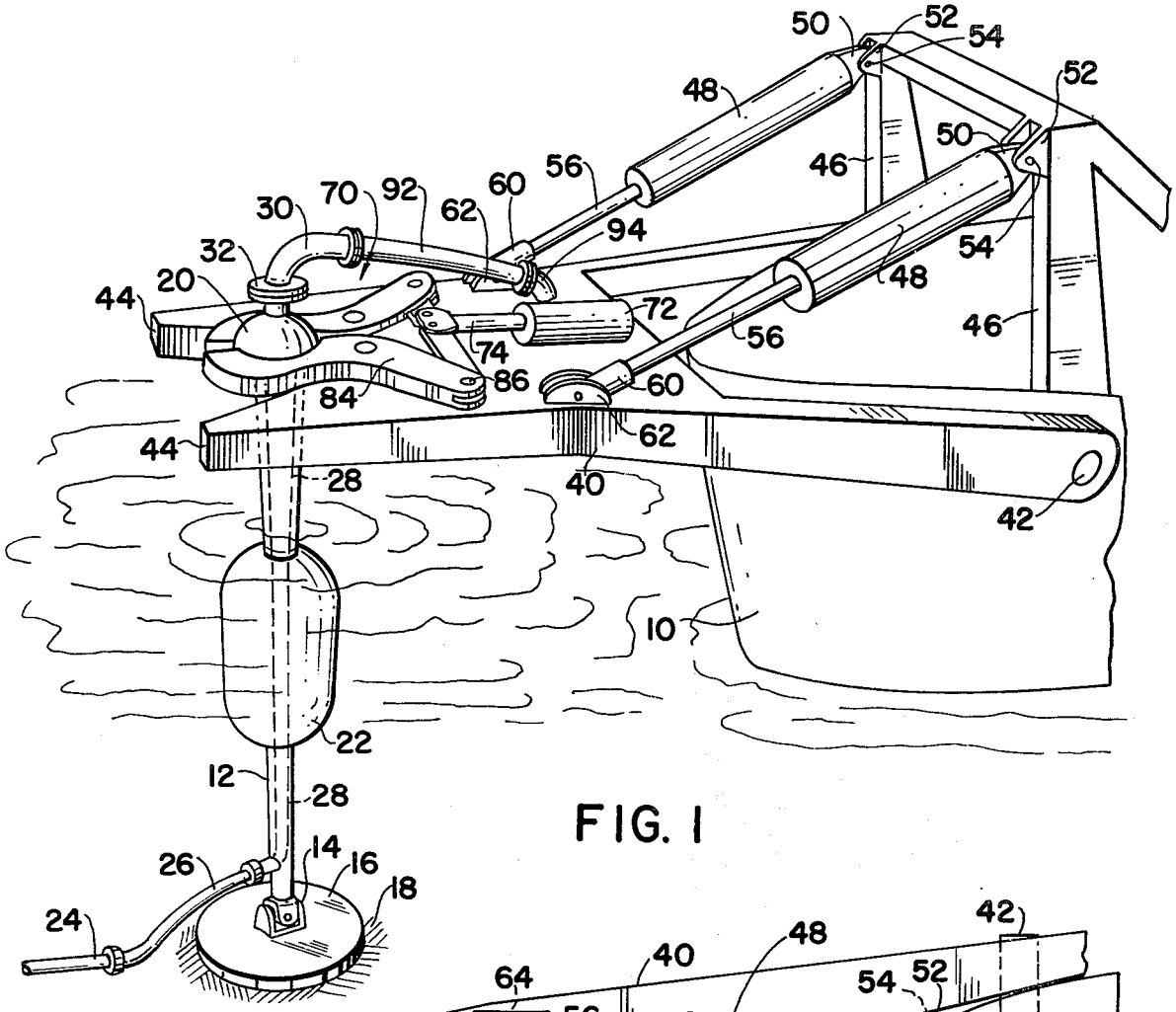
FIG. 1 is a perspective view of the preferred embodiment of a riser with the yoke mooring system detachably coupled thereto in accordance with the principles of the present invention.
Figure 2:
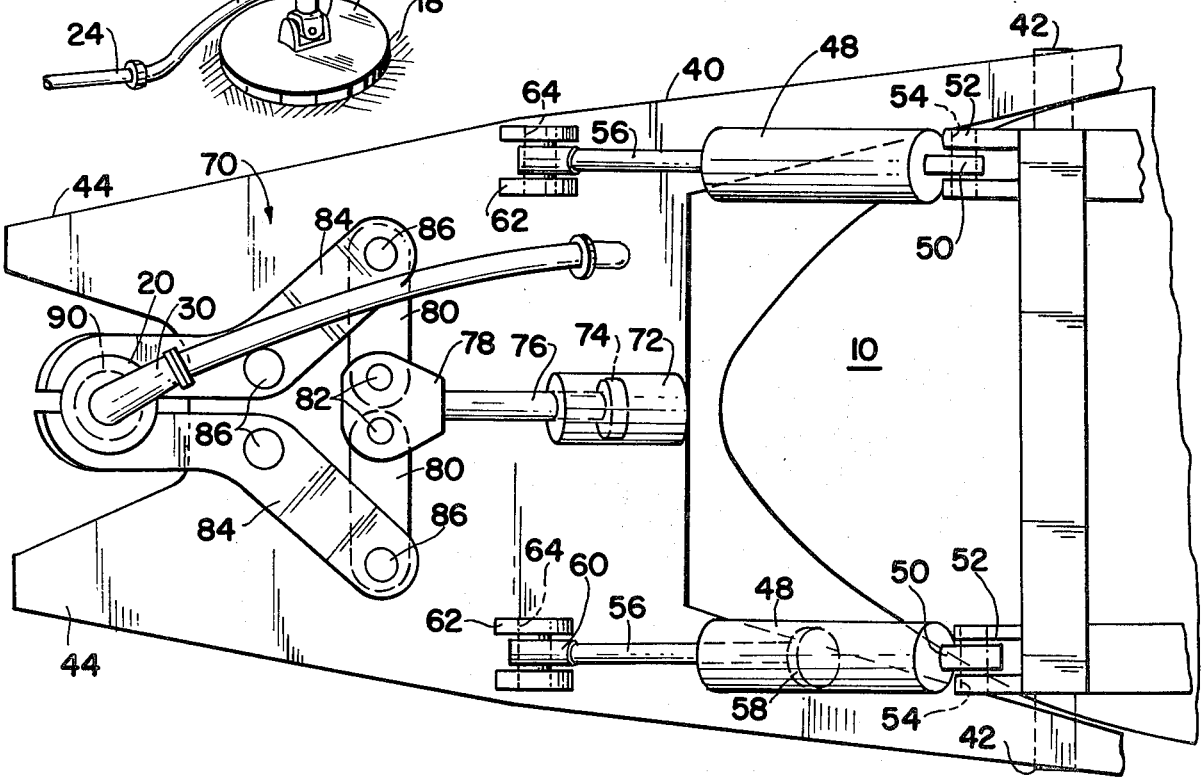
FIG. 2 is a top plan view of the riser with the yoke mooring system coupled thereto; selected components of the yoke mooring system being omitted for the sake of clarity.
Figure 3:
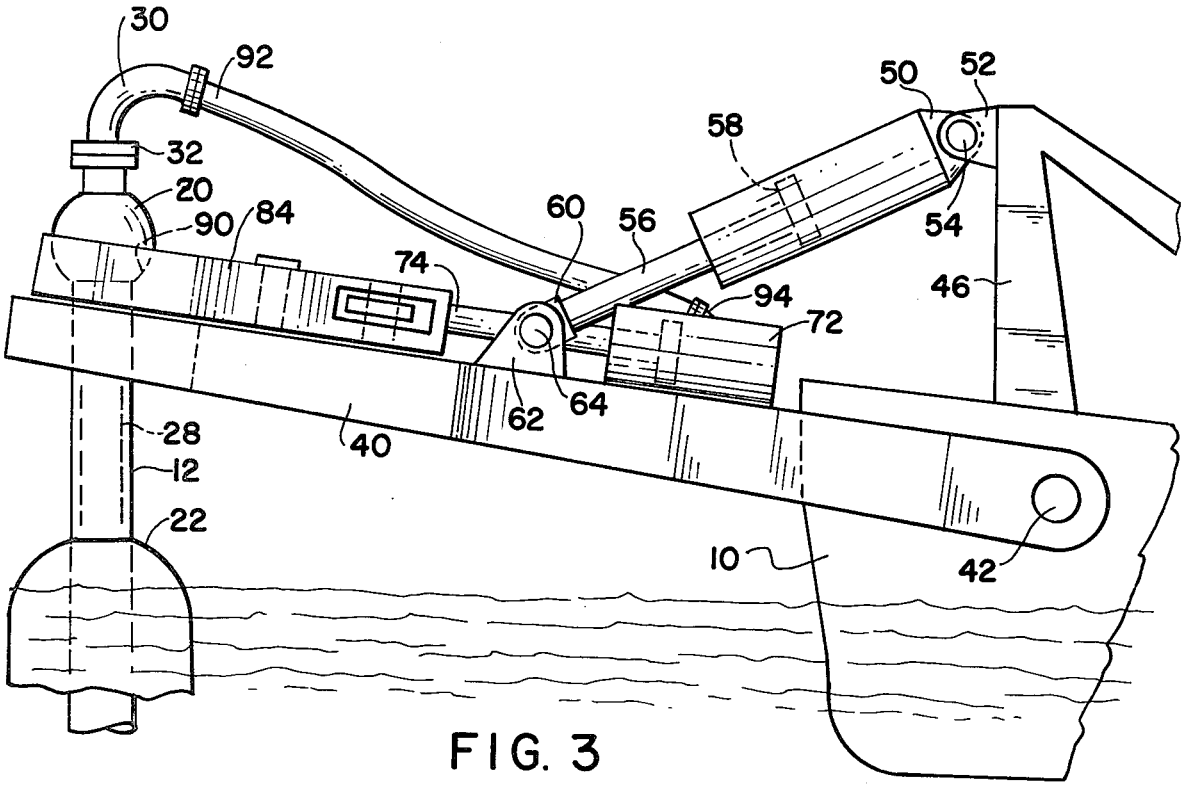
FIG. 3 is a side elevation view of the riser with the yoke mooring system coupled thereto.

Refer now to the drawings, wherein like parts are designated by the same reference numerals in FIGS. 1 through 3. These figures show a storage vessel 10 which is detachably coupled or moored to a riser 12 that is permanently joined by a universal joint 14 to a mooring base 16 secured to the sea floor 18. The free end of the riser 12 projects upwardly above the water line, and a ball 20 is situated adjacent to the upper end of the riser. A buoyant float 22 situated on the riser 12 just below the water line, assists in restoring the riser to a vertical orientation in the event that external forces cause the riser to tilt away from its vertical orientation. An underwater pipeline 24 communicates through a flexible hose 26 with a pipe 28 situated within the riser 12. The pipe 28 extends up the riser and communicates with a pipe elbow 30 through swivel joint 32 attached to the top of the riser above the ball. The pipeline 24 receives fluid cargo from a remote source (not shown).

The vessel 10, which may be a shuttle tanker, has a yoke 40 pivoted on its forecastle by pins 42 located on opposite sides of the vessel and on an axis transverse to the centerline of the vessel. The yoke is free to pivot in a vertical plane with respect to the vessel, but is restrained against pivoting in a horizontal plane with respect to the vessel. The free end of the yoke extends beyond the bow of vessel 10 and terminates in a pair of diverging guide horns 44.

A set of kingposts 46 extends above the vessel 10, and hydraulic cylinders 48 extend between the kingposts and the yoke 40. A bracket 50 on each cylinder 48 is retained between clevises 52 on the respective kingpost by clevis pins 54. A piston rod 56 attached to piston 58 within each cylinder 48 projects from the cylinder. A head 60 on the end of the piston rod 56 is fastened between clevises 62 on the yoke 40 by a clevis pin 64. The yoke 40 is pivoted about pins 42 by actuating the hydraulic cylinders 48 to extend or retract the piston rods 56 to raise or lower the yoke.

The clamping mechanism indicated generally by reference numeral 70, is mounted near the outboard end of yoke 40 and is detachably coupled to ball 20 on riser 12. The clamping mechanism 70, comprised of hydraulic cylinder 72, is mounted on the upper surface of yoke 40. A piston 74 within the cylinder is attached to a piston rod 76 which extends from the cylinder. The forward end of rod 76 terminates in head 78. Links 80 are secured to head 76 by pins 82. Clamping arms 84 are mounted on pivots 86 on either side of the center line at the front of the yoke.

The clamp arms 84 are suitably shaped and positioned such that, when the piston rod is fully extended the front ends of the clamp arms extend forward from the yoke and essentially come together; and when the piston rod is fully retracted the front ends pivot and draw apart. Depression 90 formed near the forward ends of clamp arms 84 forms a hemispherical cavity when the clamp arms close together. When the clamping arms are closed together, the hemispherical socket formed by the depressions 90 receives and snugly seats the ball 20 on the riser 12.

Figure 4:
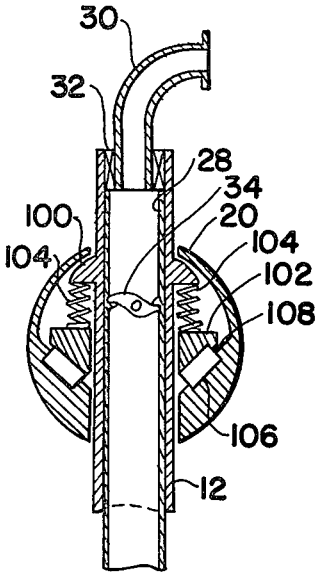
FIG. 4 is a fragmentary cross-sectional view of a ball rotatably mounted about the upper end of the riser, such ball being shown in its normal, unmoored condition with a valve blocking cargo flow through the riser.

FIG. 4 shows the ball 20 in the unmoored position, i.e., when no vessel is moored thereto. Pipe elbow 30 is secured to the upper end of riser 12 by a fluid swivel 32 which communicates with riser pipe 28. Cargo hose 92 connects between pipe elbow 30 and piping 94 on the yoke 40. A cargo fluid shut-off valve 34 is mounted within the pipe 28 in the vicinity of the ball 20.

A flange 100 protrudes from the outer wall of the riser 12, and the interior of ball 20 rests thereupon when the ball is in the unmoored position. A bearing ring 102 is located circumferential about riser 12 within the ball. Springs 104 extend between flange 100 and the bearing ring 102. The springs normally hold the bearing ring down in the unmoored position as shown in FIG. 4. The lower portion of the ball is reinforced for added structural integrity, and an annular bearing race 106 is formed in the reinforced section. Rollers 108 are positioned between the bearing race and the bearing ring 102. By virtue of this arrangement, ball 20 may rotate freely about the axis of riser 12.

Figure 5:
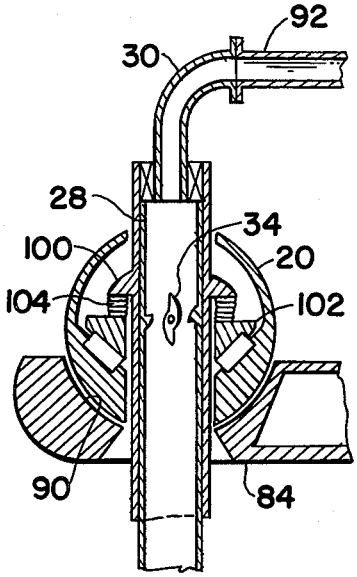
FIG. 5 is a view similar to FIG. 4 with the ball being shown in its moored condition with the valve opened to allow cargo flow through the riser.

FIG. 5 shows the ball 20 in the moored position, i.e., when vessel 10 is coupled thereto by the clamping mechanism 70 operatively associated with yoke 40. As this fragmentary view of clamping arm 84 depicts, the ball 20 is engaged in the hemispherical socket defined by the depressions 90 in the clamping arms 84. The yoke 28 is then elevated so that the clamping arms lift up on ball 20 and compress the biasing springs 104 between bearing ring 112 and flange 100. At the same time, the butterfly valve 34 is pivoted 90° (by connecting linkage not shown) to a vertical orientation so that fluid cargo can flow up the riser pipe 28, past the open valve 34, and through the elbow 30 into cargo hose 92.

CYCLE OF OPERATION FOR PREFERRED EMBODIMENT

The operation of the preferred embodiment of the detachable coupling mechanism shown in FIGS. 1–5 is now summarized to show the functional and structural correlation of the mechanism components. As shown schematically in FIG. 1, the riser 12 is connected by a universal joint 14 to a mooring base 16 on the ocean floor 18 and is held upright by a float 22 situated near its upper end. A spherical ball 20 is attached to the riser 12 near its upper end and above the float 22.

As shown in FIGS. 1–3, the yoke 40 is pivoted in a vertical plane about pins 42 mounted near the bow of vessel 10 and extends forward of the bow of the vessel 10. Hydraulic cylinders 48 secured to kingpost 46 on the vessel support the yoke 40. Fluid is pumped from one side of the cylinder pistons 58 to the other to extend or retract the piston rods 56 and thus change the elevation of the yoke 40.

The clamping mechanism 70 is mounted near the outboard end of yoke 40. Clamping arms 84 arranged symmetrically about the centerline of the yoke 40 and pivoted about shafts 86, so that their free ends, which extend beyond the yoke, can be closed together or opened apart. The clamping arms are operated by links 80 attached to the head 78 on the piston rod 76 of the clamping cylinder 72 mounted on yoke 40. When fluid is pumped from one side of the clamp cylinder piston 74 to the other the rod 76 is extended or retracted causing the links 80 to push or pull on the backs of the clamping arms 84 and thus to close or open, respectively, the outboard ends of the clamp arms. As shown in FIG. 5, the faces of the clamping arms have hemispherical depression 90 formed with a radius slightly larger than the radius of the ball 20 on the riser 12.

When the vessel 10 is not moored, the riser 12 rests with its axis essentially vertical supported by float 22, with the ball 20 at an elevation slightly above the forecastle of the vessel 10. As the vessel 10 approaches the riser 12, the yoke 40 is lowered by cylinders 48 so that the clamping arms 84 are slightly lower than the ball 20. Cylinder 72 is then actuated so that the outer jaws of the clamping arms 84 are opened. The vessel 10 is steered to align the ball 20 with the centerline of the yoke, then the engines are slowed down or reversed to stop the vessel 10 just beyond the ball 20. The guide horns 44 projecting forward of the yoke deflect the ball 20 toward the centerline of the yoke during the final approach of the vessel. As soon as contact is made with the riser 12, the cylinder 72 is actuated so that the clamping arms 84 are closed firmly about the ball 20 and the ball is snugly seated in the socket formed by the depression 88. The yoke cylinders 48 are then actuated to raise up the yoke 28.

As shown in FIG. 4, prior to yoke connection valve 34 in pipe 28 is normally closed. When the yoke 40 lifts up on ball 20, (FIG. 5) the lifting force overcomes the bias of springs 104 and rotates the valve lever (not shown) thus opening valve 34 and allowing fluid cargo to pass upwardly through pipe 28 and on to the vessel.

After the ball is firmly seated in the socket defined by depressions 90 near the forward end of clamping arms 84, the hose 92 is connected to the elbow 30 at the upper end of the riser 12. Fluid communication is thereby established between the riser 12 and the cargo pipe 94, which leads to storage onboard the vessel 10. Valves and pumps, not shown, at the remote end of pipeline 24 can then be actuated to move cargo to the vessel.

The bearing ring 102 within ball 20 can rotate easily upon bearings 108 about the riser 12. The pipe elbow 30 can rotate relative to riser 12 and pipe 28 due to swivel 32. Thus, once the clamping arms 84 are secured about the ball 20, the temporarily moored vessel 10 can rotate through 360° in a horizontal plane relative to the riser 12.

If it is essential to quickly depart from the mooring in an emergency, it is necessary only to open the clamp arms 84 by reversing the pressure in hydraulic cylinder 72 and lower the yoke 40 by reversing the pressure in hydraulic cylinders 48. This quick, simple operation will release the ball 20 and allow the vessel 10 to drift away from the riser 12. It will also immediately stop cargo from flowing through the piping system by allowing springs 104 to push the ball 20 downward along the riser 12 and close the valve 34 through the action of any suitable interconnection lever actuating mechanism. As the vessel 10 moves away from the riser it will apply tension to the hose 92 causing it to break. The short hose section 92 is easily replaceable when the vessel returns to the mooring. Optionally a remote controlled quick disconnect coupler, not shown, can be placed in the cargo piping system between cargo hose 92 and yoke piping 94, and this coupler can be automatically actuated when releasing from the mooring. In a normal departure from the mooring, the hose 92 is disconnected from pipe elbow 30 by conventional means.

FIRST ALTERNATIVE EMBODIMENT

Figure 6:
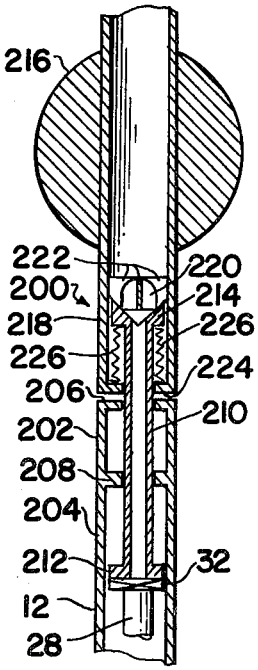
FIG. 6 is an axial cross-sectional view of a first alternative embodiment with the ball fixed to the upper portion of the riser and with a swivel joint and a normally closed valve in the riser, the ball being shown in its unmoored condition.

FIG. 6 shows a first alternative embodiment of a ball and valving arrangement suitable for use on a detachable riser and yoke mooring system. In this alternative the upper portion of the riser, indicated by reference number 200, is separate from the remaining portion of the riser 12. Sleeve bearings 202 and 204 are disposed at the top of riser 12. Annular flanges 206 and 208 accurately locate the bearings relative to the top of riser 12. A transfer pipe 210 extends axially through the bearings and projects upward from the riser 12. The lower end of transfer pipe 210 terminates in an annular flange 212 that seats and supports bearing 204. The cargo pipe 28 within the riser 12 is connected to this flange 212 through fluid swivel 32. The upper end of the pipe 210 terminates in a conically shaped, tapered seal face 214. The seal face 214 may be integrally formed, or may be fabricated with a resilient sealing insert.

A ball 216 is integrally formed with, or secured to, ball pipe 218. A seal cone 220 is situated within the ball pipe 218 below ball 216. Webs 222 position the seal cone 220 in the center of the pipe 218. The cone-shaped lower end of the seal cone 220 normally mates against the conically shaped seal face 214. Other seals are provided in the bearings and on the face of the seal cone, as needed, to insure leak-free operation.

The lower end of ball pipe 218 terminates in an annular, inwardly directed flange 224 that fits around the exterior of transfer pipe 210, and springs 226 are positioned between flange 224 and the underside of seal face 214. The springs push on the transfer pipe 218 to enhance the contact between the seal face 214 and the seal cone.

In operation, the storage vessel 10, as shown in FIGS. 1–3, approaches the upper riser 200 and the vessel is manuevered so that the clamping mechanism 70 on the yoke 40 can grasp the ball 216. The yoke 40 is then pivoted upward by pressurizing hydraulic cylinders 48. The yoke lifts the ball pipe 218 relative to transfer pipe 210 in opposition to the force of springs 226, and radial webs 222 engaging said seal cone 220 lift it upwardly away from seal face 214. Fluid cargo can thus pass upwardly from cargo pipe 28, into transfer pipe 210, and thence past the webs 222 retaining seal cone 220 in position and on through ball pipe 218. Cargo base 92 on the yoke 40 is connected to the top of ball pipe 218 to receive the cargo.

After the clamping arms 84 have securely grasped ball 216, the vessel 10 can rotate freely about the riser. The sleeve bearings 202 and 204 permit the ball pipe 218 and the transfer pipe 210 to rotate relative to the riser 12.

SECOND ALTERNATIVE EMBODIMENT

Figure 7:
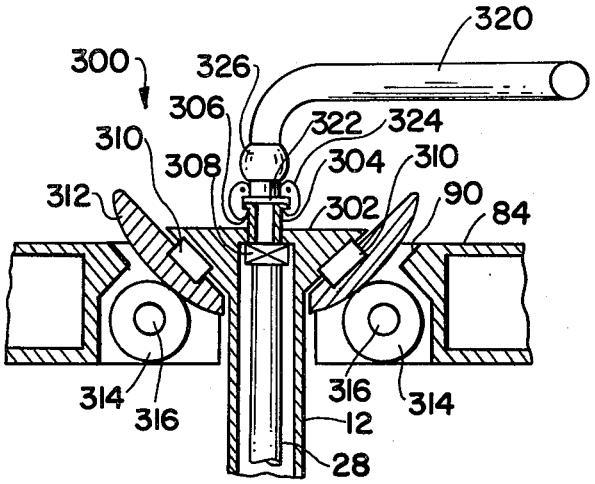
FIG. 7 is an axial cross-sectional view, on an enlarged scale, of a second alternative embodiment of the detachable coupling, such view showing a ball segment rotatably mounted on the riser which rides on rollers in the clamp arms in the moored condition.

FIG. 7 depicts a second alternative embodiment, generally indicated by reference number 300, of the yoke mooring system for detachably coupling a storage vessel to a riser. The riser 12 terminates at its upper end in a cone shaped cap 302. A pipe 304 communicates with the upper end of the conduit 28, and terminates a flange 306. A fluid swivel 308 allows the pipe 304 to rotate relative to riser pipe 28.

Bearings 310 are positioned between the cone and the ball segment 312, so that the ball segment can rotate about the riser cone 302. A plurality of clamp wheels 314 are arranged about the periphery of the depressions 90 in the clamp arms 84; their axles 316 are tangential to the hemispherical depression in the clamp arm. When the clamping arms 84 are closed around the cone 302 on the riser top 300, the clamp wheels 314 bear against the underside of the ball segment 312. Thus, the ball segment 312 can pivot in a vertical plane by rolling on the wheels 314.

A pipe arm 320 on the yoke 40 has a flange 322 at its end which abuts against flange 306. A quick-coupler 324 joins the flanges together and maintains arm 320 locked to the riser when the coupler is operated. The center point for ball segment 312 coincides with the center point for a ball joint 326; the ball joint allows riser 300 to both pivot and rotate relative to the pipe arm 320 without straining the pipe arm. The ball joint 326 is either hollow, or has passages so that fluid can pass through freely. The opposite end of the pipe arm 320 communicates with a cargo pipe on the storage vessel to complete the flow path from the riser 300.

THIRD ALTERNATIVE EMBODIMENT

Figure 8:
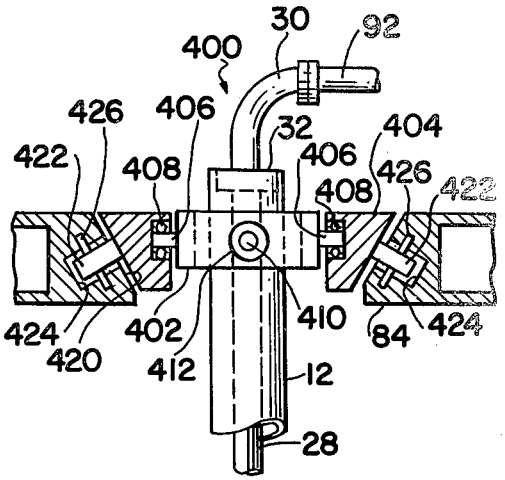
FIG. 8 is an axial cross-sectional view, on an enlarged scale, of a third alternative embodiment of the detachable coupling, such view showing a cone ring pivotally mounted on the riser which rides on rollers in the clamp arms in the moored condition.

FIG. 8 illustrates a third alternative embodiment of the detachable riser and yoke mooring system indicated by reference number 400. A universal joint ring 402 encircles the upper end of the riser 12, and a cone ring 404 encircles the joint ring. A first pair of diametrically opposed pins 406 interconnects the joint ring 402 and the cone ring 404, and the outer end of each pin rests within a bearing 408. A second pair of diametrically opposed pins 410 interconnects the joint ring with the riser 12 and the outer end of each pin rests in a bearing 412, and gimbals [allows] the ring 402 to pivot thereabout. The two pairs of pins 406 and 410 serve, in effect, as a universal joint.

The clamping arms 84 have a tapered conical socket 420 defined therein. Clamp wheels 422 are located within recesses 424 in the wall defining the socket and turn on axles 426 parallel to the sloping side of cone ring 404. When the clamp arms are closed about the top of the riser, the wheels bear against the outer, sloping side of cone ring 404.

When a vessel is moored to embodiment 400, the clamping arms 84 surround and engage the lower part of the cone ring 404, as shown in FIG. 8. The clamp wheels 422 bear securely against the outer surface of the cone ring. Thus, the clamping arms 84 and the clamping mechanism 70 on the yoke of the moored vessel can rotate about the cone ring 404. The riser 12 by virtue of pins 406 and 410 can pivot with respect to the clamp arms 84. Cargo hose 92 for communicating with the piping on the yoke 40 is connected to the elbow 30 which connects through fluid swivel 32 to cargo piping 28 within the riser.

FOURTH ALTERNATIVE EMBODIMENT

Figure 9:
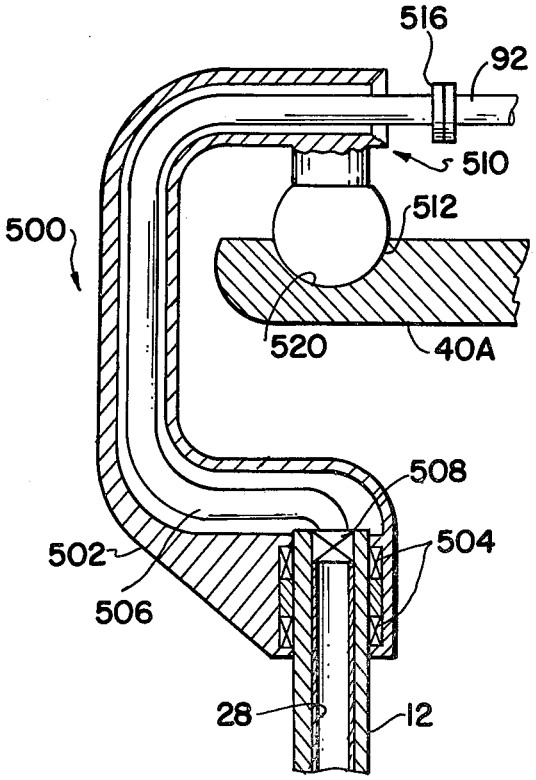
FIG. 9 is a vertical cross-sectional view, on an enlarged scale, of a fourth alternative embodiment of the detachable coupling, such view showing a hook shaped riser pipe terminating in a ball which rests in a spherical depression in the end of the yoke in the moored condition.

FIG. 9 depicts a fourth alternative embodiment of the detachable riser and yoke mooring system indicated by reference numeral 500. A C-shaped riser extension 502 is secured to the upper end of the riser 12 through bearings 504. A cargo pipe 506 within the pipe arm 502 is connected through a fluid swivel 508 to the piping 28 within the riser. A ball stub 510 extending downward from the end of the riser extension is located on the centerline of the riser 12 with its spherical face 512 extending downward.

In contrast to the preferred embodiment of the yoke mooring system of FIGS. 1–5, and the alternative embodiments of the yoke mooring systems shown in FIGS. 6 and 7, and 8, respectively, the alternative embodiment of FIG. 9 obviates the need for the clamping arms 84 and the mechanism for operating same. A simple concave spherical socket 520 is formed near the free end of yoke 40A. The socket 520 is slightly larger in radius than the surface 512 of the ball stub. One of the contacting surfaces 512 or 520 may be surfaced with a lubricant impregnated bronze, while the other contacting surface is fabricated with a compatible material.

In operation, as the vessel is manuevered toward riser alternative 500, the yoke 40A is lowered to pass into the gap of the C-shaped riser extension 502 and beneath the ball stub 510. As soon as the ball stub 510 is positioned above the socket 520, the yoke 40A is raised about its pivot point so that the ball stub is seated in the socket 520. Once the mooring has been completed, a cargo hose 92 extending from the yoke can be connected to the pipe flange 516 on the end of the cargo pipe 506.

The alternative embodiment of FIG. 9 is far simpler in construction and design than the previously described embodiments of the yoke mooring system, for the clamping arms 84 and the mechanism for operating them are omitted. However, the approach to the riser 500 must be made within approximately a 180° sector, so that the back of the riser extension 502 does not interfere with the seating of the ball stub 510 in the socket 520 on the yoke. Once the connection is achieved, the vessel can swing completely about the riser in a horizontal plane due to the bearings 504 between the riser extension 502 and the riser 12. The bearing ball surface 512 and socket 520 provide for pivoting of the riser relative to the yoke.

It will be readily apparent to one skilled in the art that various features from one embodiment of the detachable coupling could be easily combined with other features from the several other embodiments. Yet further modifications, revisions and alterations to the detachable riser arm yoke mooring system will be suggested to the skilled artisan.

In order to secure for the inventor adequate protection for his significant contribution to the useful arts and sciences to which this invention pertains, the following claims should be broadly construed and should not be limited to their literal terms.

What is claimed is:

1. A mooring system for a vessel floating in a body of water comprising:

(a) single riser means attached to the floor of said body of water and extending above the surface of said body of water in a substantially vertical position;

(b) a protuberance situated upon said riser means near the upper end thereof;

(c) a yoke secured to said vessel for pivotal movement in a vertical plane relative to said vessel;

(d) said yoke including an opposed pair of pivoted clamp arms having complementary recesses defining socket means to receive said protuberance therein;

(e) operating means located on said yoke for pivoting at least one of said clamp arms to secure said protuberance in said socket means; and (f) bearing means situated between said protuberance and said riser means so that said vessel can pivot 360° in a horizontal plane relative to the riser means after said protuberance has been secured in the recesses of said socket means without displacing said protuberance from said socket means.

2. A mooring system as defined in claim 1 wherein said protuberance is symmetrical about the axis of said riser means and is located above the surface of said body of water.

3. A mooring system as defined in claim 2 further comprising bearing means so that said riser can pivot in a vertical plane relative to said vessel.

4. A mooring system as defined in claim 3 wherein said protuberance is a generally spherical member and said recesses in said clamp arms are substantially hemispherical in shape.

5. A mooring system as defined in claim 4 wherein said operating means includes a hydraulic cylinder retained upon said yoke and a piston rod extending from said cylinder and movable relative thereto so that said arms are positively opened and closed by said hydraulic cylinder.

6. A mooring system as defined in claim 5 wherein a circumferential ring is formed on the exterior of said riser means, said spherical member is at least partially hollow, and rests upon said circumferential ring.

7. A mooring system as defined in claim 6 wherein said bearing means comprises a bearing ring that fits around the exterior of said riser means, and within said spherical member.

8. A mooring system as defined in claim 7 further comprising a cargo pipe extending along said riser means, a fluid swivel secured to the upper end of said riser means, and a cargo pipe extending along said yoke.

9. A mooring system as defined in claim 8 further comprising valve means situated within said riser means for controlling fuel flow therethrough, and biasing means for normally retaining said valve means closed.

10. A mooring system as defined in claim 9 further including valve operator means between said spherical member and said valve means, such that the action of said yoke and said clamp arms overcomes said biasing means and opens the valve means.

11. A mooring system as defined in claim 4 wherein said protuberance comprises a rotatable extension to said riser means.

12. A mooring system as defined in claim 11 further comprising cargo piping within said riser means and additional cargo piping within said extension, said additional cargo piping communicating with said cargo piping through valving means.

13. A mooring system as defined in claim 12 wherein said valve means includes a valve seat, a valve surface that mates with said valve seat, and biasing means to urge said valve seat and said valve surface together.

14. A mooring system as defined in claim 13 such that the action of said yoke and said clamp arms overcomes said biasing means lifting said valve surface from said valve seat so that fluid cargo can pass thereby.

15. A mooring system as defined in claim 3 wherein said clamp arms include wheels arranged to roll against the exterior of said protuberance.

16. A mooring system as defined in claim 15 wherein said protuberance comprises a conical collar which is pivoted by a universal joint secured to the upper end of said riser means.

17. A mooring system as defined in claim 16 wherein said wheels are secured to axles that are parallel to the slope of the exterior surface of said conical collar.

18. A mooring system as defined in claim 15 wherein said protuberance comprises a spherically shaped segment rotatably mounted on bearings about said riser.

19. A mooring system as defined in claim 18 wherein said wheels are secured to axles that are tangent to the surface of said spherically shaped segment.

20. A mooring system as defined in claim 1 further including hydraulic means extending between said vessel and said yoke.

21. A mooring system as defined in claim 1 further including guide means located at the free end of said yoke to guide the protuberance toward said socket means.

22. A mooring system for a vessel floating in a body of water comprising:

(a) riser means attached to the floor of said body of water and extending above the surface of said body of water in a substantially vertical position;
(b) a protuberance situated upon said riser means near the upper end thereof and above the surface of said body of water;
(c) said protuberance being movable in an axial direction along said riser means;
(d) valve means situated on said riser means for controlling flow therethrough;
(e) resilient means for normally urging said valve means toward a closed position;
(f) a yoke secured to said vessel for pivotal movement in a vertical plane relative to said vessel;
(g) socket means on said yoke to receive said protuberance therein; and
(h) power means connected between said yoke and said vessel, said power means, when actuated, pivoting said yoke with sufficient force to lift said protuberance, overcome said resilient means, and open said valve means.

23. A mooring system for a vessel floating offshore in a body of water comprising:

(a) riser means attached to the floor of said body of water and extending above the surface of said body of water in a substantially vertical position;
(b) a 'c' shaped riser extension secured to the upper end of said riser means;
(c) a protuberance extending downwardly from said riser extension;
(d) a yoke secured to said vessel for pivotal movement in a vertical plane relative thereto;
(e) socket means defined in an upper surface of said yoke adjacent the free end thereof for engaging a lower surface of said protuberance; and
(f) bearing means situated between said riser means and said riser extension so that said vessel can pivot freely in a horizontal plane relative to said riser means after said protuberance has been seated within said socket means.

24. A mooring system as defined in claim 23 further including a transfer pipe disposed within said riser extension, and a fluid swivel for securing said transfer pipe to said riser means.

25. A mooring system as defined in claim 24 wherein the vertical center line of the riser means coincides with the vertical center line of said protuberance.

26. A mooring system as defined in claim 25 wherein said said protuberance and said socket are spherical in shape and of substantially the same radius.

27. A mooring system for a vessel floating offshore in a body of water comprising:

(a) riser means attached to the floor of said body of water and extending upwardly above the surface of said body of water in a substantially vertical position;
(b) a protuberance with a vertically extending axial passage situated upon said riser means near the upper end thereof and above the surface of said body of water;
(c) a yoke secured to said vessel for pivotal movement in a vertical plane relative to said vessel;
(d) pivoted clamping means mounted on said yoke;
(e) said clamping means including opposed semi-circular recesses defining socket means to receive said protuberance therein;
(f) first bearing means so that said vessel can pivot in a horizontal plane relative to the riser means after said protuberance has been seated in said socket means; and (g) second bearing means so that said vessel can move in a vertical plane without displacing said protuberance from said socket means.

28. A mooring system as defined in claim 27 wherein said second bearing means comprises a ball segment positioned within said socket means, and said first bearing means comprised a bearing between said riser and the ball segment.

29. A mooring system as defined in claim 28 wherein a plurality of clamp wheels extend into said socket means and roll on said ball segment.

30. A mooring system as defined in claim 27 wherein said first bearing means comprises a conical ring positioned within said socket means, and said second bearing means comprise of universal gimbal joint means between said riser and the conical ring.

31. A mooring system as defined in claim 30 wherein a plurality of clamp wheels extend into said socket means and roll on said conical ring.

* * * * *